US006929515B1

(12) United States Patent
Schneider et al.

(10) Patent No.: US 6,929,515 B1
(45) Date of Patent: Aug. 16, 2005

(54) IN-LINE AC ADAPTER FOR CAMPING AND MARINE ELECTRICAL SERVICE

(76) Inventors: Robert Schneider, 914 Curlew Rd., Dunedin, FL (US) 34698; Peter MacKay, 115 Whitford St., Warwick, RI (US) 02889-8038; Thomas Fanelli, 1381 Kildaire Farm Rd., Cary, NC (US) 27511

( * ) Notice: Subject to any disclaimer, the term of this patent is extended or adjusted under 35 U.S.C. 154(b) by 2 days.

(21) Appl. No.: 10/887,936

(22) Filed: Jul. 9, 2004

(51) Int. Cl.[7] ..... H01R 25/00
(52) U.S. Cl. ..... 439/654
(58) Field of Search ..... 439/638, 651, 439/653, 655

(56) References Cited

U.S. PATENT DOCUMENTS 4,053,788 A * 10/1977 Robie ..... 307/11
4,111,516 A * 9/1978 Wireman ..... 439/490
4,173,383 A * 11/1979 Lee ..... 439/105

* cited by examiner

*Primary Examiner*—Ross Gushi
*Assistant Examiner*—Briggitte R. Hammond
(74) *Attorney, Agent, or Firm*—Mills Law Firm PLLC

(57) ABSTRACT

A compact inline unitized plug/receptacle adapter interconnects a four blade plug configuration with a three slot receptacle thereby allowing a boat or RV user to readily adapt to an available receptacle at mooring or camping sites while retaining the ability to utilize the electrical equipment therein. The adapter includes a cover assembly carrying on the outer end the three blades for connection with a host receptacle and carrying on the inner end the four terminals for connection with the guest plug. The live or hot terminals are interconnected by a jumper bus mounted at a raised pad on the cover and electrically connected with the live blade. The neutral and ground terminals are separately connected with their respective blades and mounted at pads of differing elevation on the cover thereby providing differing base elevations and a first degree of physical and electrical insulation between the hot and neutral/ground paths. The adapter includes a housing having a cavity provided with walled surfaces forming separate insulating pockets for aligning the individual terminals with slots for accepting the four blade guest plug. The pockets physically and electrically laterally separate the terminals to provide a second degree of physical and electrical insulation between the terminals.

9 Claims, 5 Drawing Sheets

IN-LINE AC ADAPTER FOR CAMPING AND MARINE ELECTRICAL SERVICE

FIELD OF THE INVENTION

The present invention relates to interfacing differing electrical systems, and, in particular, to an adapter for connecting electrical lines of dissimilar terminal configurations.

BACKGROUND OF THE INVENTION

At recreational facilities such as marinas and camping sites, electrical hookup connections are provided to enable boaters and campers to secure electrical service for their boats and recreational vehicles. Service at such sites is typically provided in two modes; 30 ampere receptacles and 50 ampere receptacles. Each mode has distinct code approved configurations for the connections. Oftentimes, because of supply and demand, the needed interface configuration is not available, and an adapting device is required to achieve electrical service. Typically, such situations arise wherein the transport includes a 50 ampere service plug and only a 30 ampere service is available at the site.

The prevalent commercially available adapter is an extension cord, over a foot in length, having a molded plug connector at one end and a molded receptacle connectors at the other end. The cord is necessary to separate the terminals at the respective ends for insulating purposes. In addition to being cumbersome and difficult to stow on board, the molded construction and connecting cable can present problems in use at the site. Movement of the cable, due to environmental conditions and physical contact, can create a torque flexing the connectors and reducing or interrupting the insulating barrier between the internal terminals resulting in malfunction and/or electrical shorting. Moreover, the operating conditions can degrade the material integrity also causing performance and safety problems. The relatively small size of the connectors can make installation and removal difficult.

BRIEF SUMMARY OF THE INVENTION

The present invention provide a compact inline unitized plug/receptacle for interconnecting a four blade plug configuration with a three slot receptacle thereby allowing the boat or RV user to readily adapt to available receptacles at the mooring or camping site while retaining the ability to utilize the electrical equipment therein. The adapter uses injection molded thermoplastic components to provide high environmental and chemical resistance with a high strength and insulating properties. The adapter includes a cover assembly carrying on the outer end the three blades for connection with a host 30 ampere receptacle and carrying on the inner end the four terminals for connection with the guest 50 ampere plug. The live or hot terminals are interconnected by a jumper bus mounted at a raised pad on the cover and electrically connected with the live blade. The neutral and ground terminals are separately connected with their respective blades and mounted at pads of differing elevation on the cover thereby providing differing base elevations and a first degree of electrical insulation between the hot and neutral/ground paths. The adapter includes a housing having a cavity provided with walled surfaces forming separate insulating pockets for receiving in assembly the individual terminals in alignment with slots for accepting the four blade guest plug. The pockets physically and electrically laterally separate the terminals to provide a second degree of insulation between the terminals. As a result the terminals and respective connecting elements can be accommodated in a single short length package that can be conveniently stored on board. The adapter envelope is generally cylindrical of a size comfortably manually grasped for self aligning axial insertion at the mating interface. Axial movement is assisted by raised tabs on the sides of the housing. The adapter and internal components are resistant to weather conditions, physical impact and connecting cable movement.

Accordingly, it is an object of the invention to provide an adapter between is dissimilar electrical interfaces that is compact and easy to remove and install.

Another object is to provide a unitized inline adapter for connecting a four blade plug configuration to a three socket receptacle configuration.

A further object is to provide an adapter for exterior use in connecting a high amperage auxiliary power cord of a parked boat or camping vehicle with a lower amperage power supply at a mooring or camping site.

A still further object is to provide an in line AC adapter for connecting differing amperage circuits wherein the internal electrical paths are separated by plural degrees of electrical isolation.

DESCRIPTION OF THE DRAWINGS

The above and other features and advantages of the invention will become apparent upon reading the following detailed description taken in conjunction with the accompanying drawings in which.

DETAILED DESCRIPTION OF THE PREFERRED EMBODIMENTS

Figure 1:
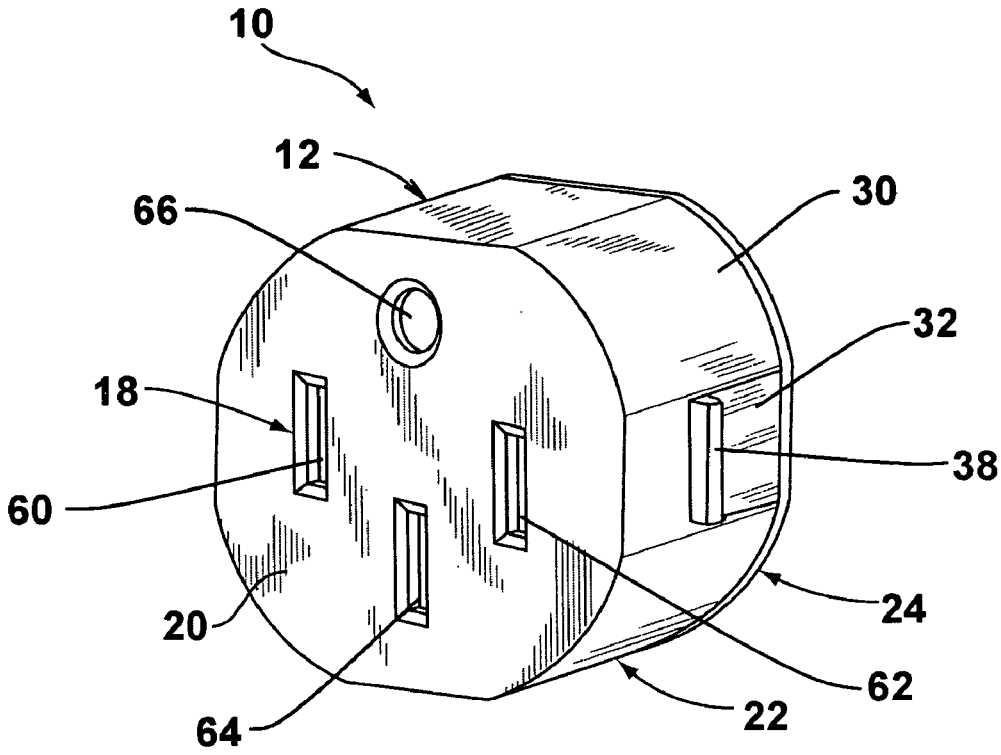
FIG. 1 is a front perspective view of an in-line AC adapter according to an embodiment of the invention illustrating the 50 ampere socket array.
Figure 2:
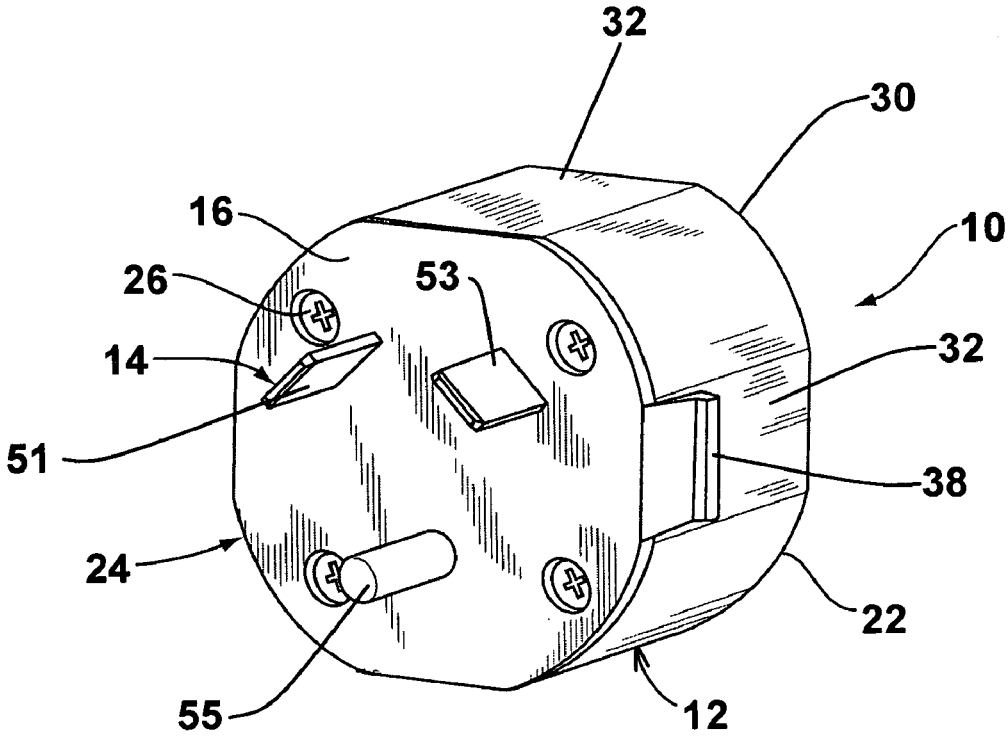
FIG. 2 is a rear perspective view of the adapter of FIG. 1 illustrating the 30 ampere plug array.

Referring to the drawings, FIGS. 1 and 2 show an in-line AC adapter 10 for facilitating electrical connection between a host receptacle supplying electrical power to a guest plug, wherein the guest plug cannot directly interface with the host receptacle. The present invention will be described with reference to electrical service sites such as camping grounds and marinas whereat recreational vehicles, boats and the like are temporarily located and electrical service is required.

Service at such sites is typically provided in two modes; 30 ampere receptacles and 50 ampere receptacles. Each mode has distinct code approved configurations for the connecting plugs. Oftentimes, the requisite configuration is not available, and an adapting device is required to achieve electrical service. Typically, such situations arise wherein a host transport includes a 50 ampere service plug and only a 30 ampere service is available at the site. The prevailing standard configurations for the 50 ampere service are NEMA 14-50P for the plug and 14-50R for the receptacle, and for 30 ampere service are NEMA TT-30P for the plug and TT-30R for the receptacle. The 50 ampere configuration is characterized by a plug array of diametrically opposed hot blades and orthogonal diametrically opposed neutral blade and grounding blade or post. The 30 ampere configuration is characterized by a plug array of oppositely inclined and spaced hot and neutral blades and an orthogonally spaced grounding post. The adapter will be described with reference to an electrical interface between these two configurations.

The adapter 10 comprises a housing assembly 12 having a 30 ampere plug array 14 of NEMA 14-50P configuration at base end wall 16 (FIG. 2) and a 50 ampere receptacle array 18 of NEMA 14-50R configuration at the longitudinally spaced top end wall 20 (FIG. 1). The housing assembly 12 comprises a housing 22 carrying a cover assembly 24, which is telescopically assembled thereto and secured by fasteners 26.

The housing 22 comprises a cylindrical side wall 30 having four equally circumferentially spaced, axially or longitudinally extending planar flats 32, and the end wall 20, the inner surfaces of which define a mounting cavity 34 having a plurality of pockets opening toward the cover assembly 24 and axially registering with the receptacle array 18, as described in detail below. A pair of opposed flats 32 include raised transverse ribs 38 for facilitating manual gripping of the adapter 10 for insertion and removal. The housing 22 is a one-piece plastic molding formed of a heat and chemical resistant thermoplastic resin. Suitable materials are available in the Valox series from General Electric Plastics.

Figure 3:
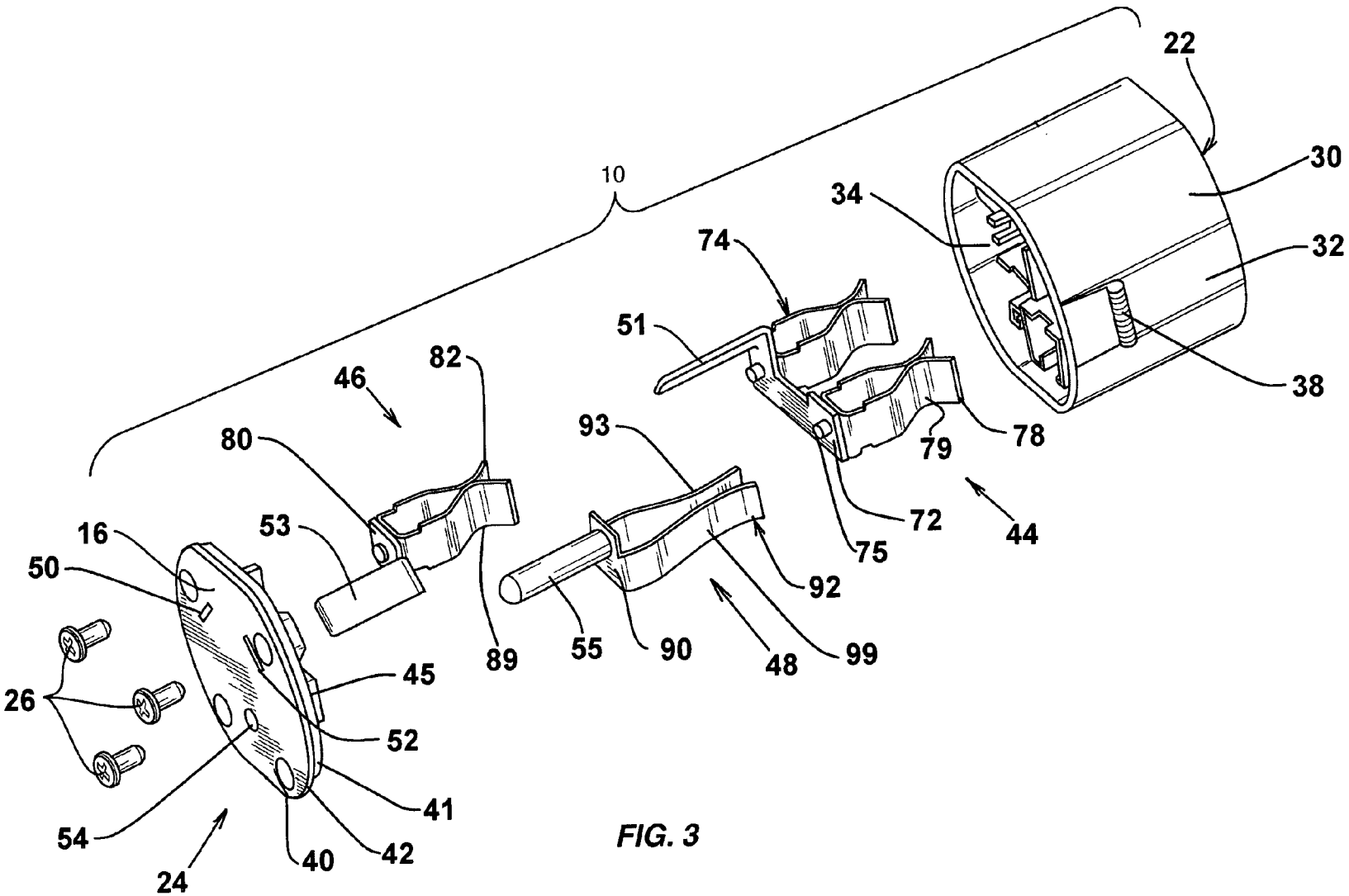
FIG. 3 is an exploded perspective view of the adapter illustrating the various component parts.
Figure 4:
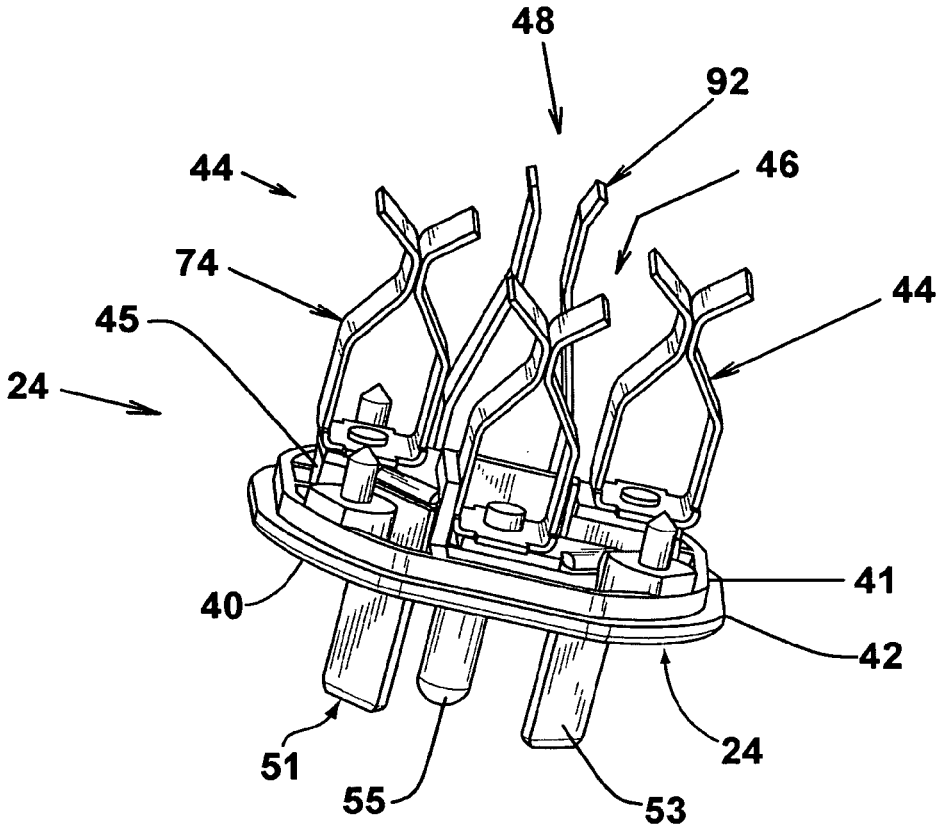
FIG. 4 is a perspective view of the cover assembly of the adapter.
Figure 5:
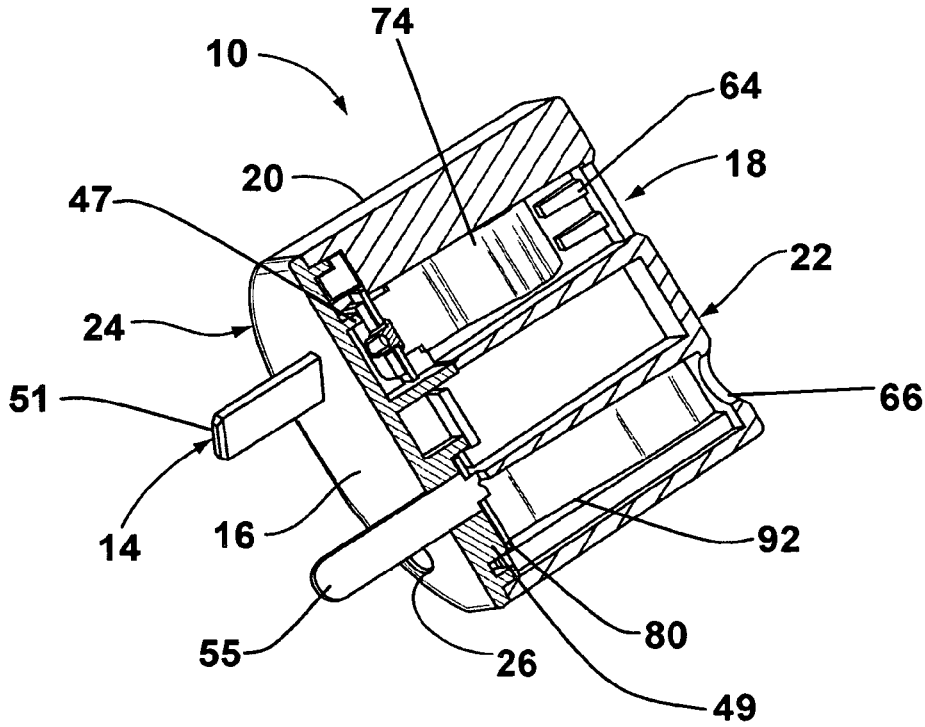
FIG. 5 is an axial perspective cross sectional view through the ground assembly.

Referring to FIGS. 3 and 4, the cover assembly 24 comprises a base 40 having a inner peripheral shoulder 41 outwardly bounded by a peripheral flange 42. The shoulder 41 has a sliding telescopic fit with the front end of the cavity 34. The flange 42 has an outer wall complementary with the side wall 30. The base 40 carries on an inner wall a hot lead contact assembly 44 on a mounting pad 45, a neutral lead contact assembly 46 on a mounting pad 47 (FIG. 5), and a ground lead contact assembly 48 on a mounting pad 49 (FIG. 5). The pads 45 is at a first elevation with respect to the base, and the pads 47 and 49 are at a second and/or third elevation with respect to the base and below the pads 45 thereby providing first degree of physical and electrical separation between the contact assemblies.

The base 40 includes through slots conforming to the array 14 including a blade slot 50 for receiving the blade 51 of the hot lead contact assembly 44, a neutral blade slot 52 for receiving the blade 53 of the neutral lead contact assembly 46, and a ground hole 54 for receiving the post 55 of the ground contact lead assembly 48. The slots 50, 52 have an appropriate rectangular cross section for receiving the blades 51, 53. The ground hole 54 has an appropriate circular cross section for receiving the post 55 of the ground contact lead assembly 48.

Referring to FIG. 1, the housing 22 includes openings in the end wall 20 conforming the array 18 including a first hot socket slot 60 for receiving one hot lead blade of the guest plug, a second hot socket slot 62 for receiving the other hot lead blade of the guest plug, a neutral socket slot 64 for receiving the neutral blade of the guest plug, and a ground socket 66 for receiving the ground post of the guest plug. The cavity 34 on the housing 22 includes internal wall surfaces defining axially extending, frontally opening pockets 68, each of which registers with an opening in the array 18 and opens toward the cover assembly 24 for receiving the terminals of the respective contact assemblies.

Figure 8:
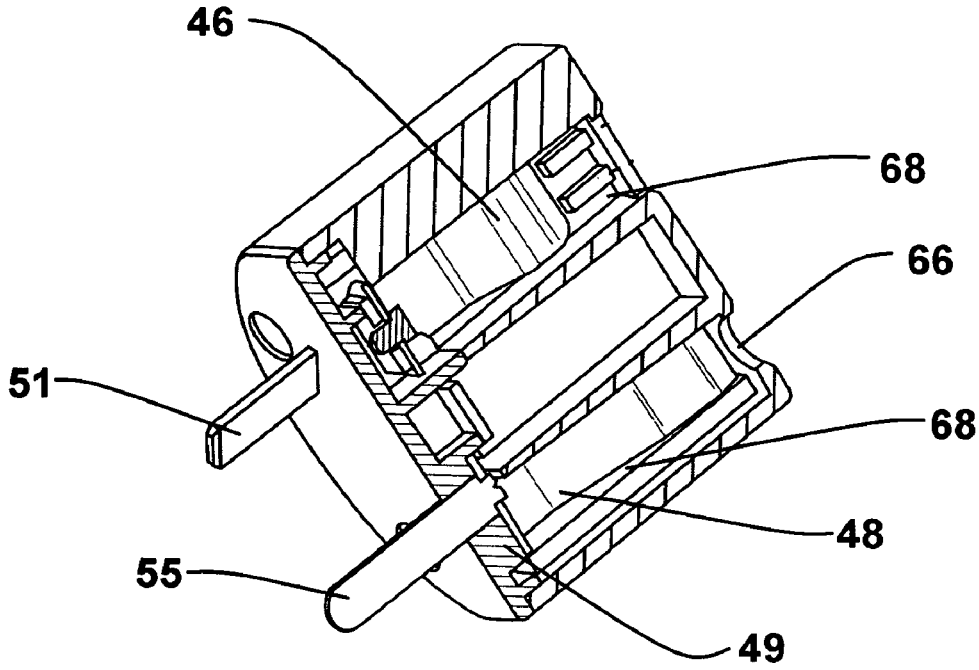
FIG. 8 is an axial perspective cross sectional view through the ground post.
Figure 9:
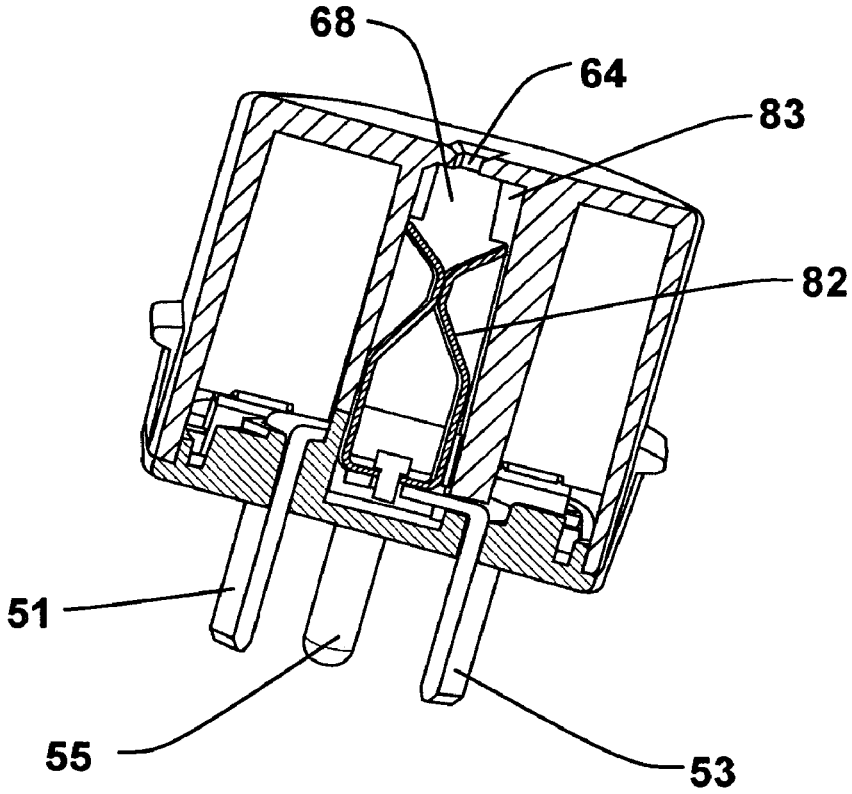
FIG. 9 is an axial perspective cross sectional view through the neutral lead assembly.

As shown in FIG. 8, a plurality of cylindrical sleeves 70 are formed in the cavity 34 and terminate with a cylindrical insert 71 into which the shanks of the fasteners 26 are threaded to assemble the cover assembly 24 to the housing 22.

Figure 6:
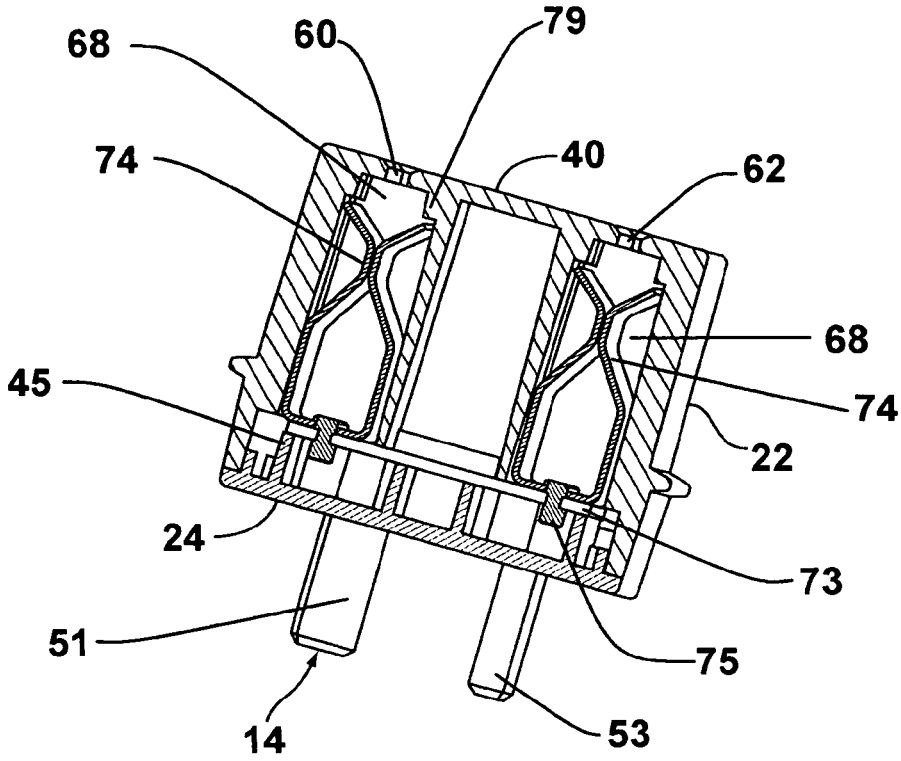
FIG. 6 is an axial perspective cross sectional view through the hot lead assembly.
Figure 7:
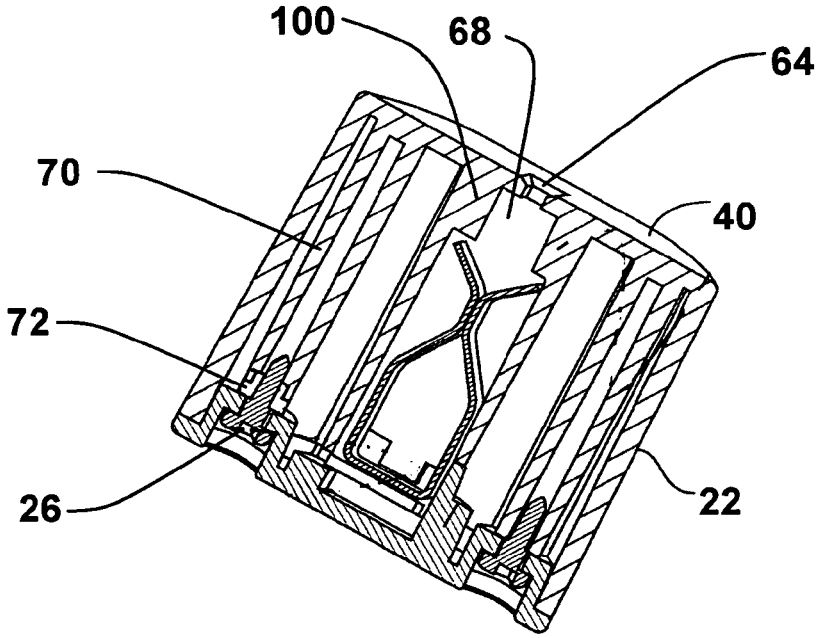
FIG. 7 is an axial perspective cross sectional view through the fasteners.

As shown in FIGS. 3 and 4, the hot lead contact assembly 44 includes the blade 51 that is integral with a reversely bent transverse jumper bus 73 carrying on a rear surface a pair of laterally spaced output terminals 74. Referring to FIG. 4, the bus 73 is carried on the raised pads 45 and registers with the pockets 68 of the hot sockets in the housing 22 (FIG. 6). Each output terminal 74 includes a base attached to the bus 73 by a rivet 75. Each terminal 74 includes a pair of upwardly extending contact legs 78 having inwardly bent closely spaced contact sections 79 that resiliently deflect outwardly upon mating with the associated host hot blade in assembly. Ribs 77 adjacent the slots 64 maintain the axial positions of the terminals.

The neutral lead assembly 46 includes the blade 53 integral with a reversely turned base 80 and an output terminal 82. Referring to FIG. 5, the base 80 is mounted on a lower mounting pad 47 and registers with the pocket 68 of the neutral socket in the housing and the neutral slot 52. The output terminal 82 includes a base riveted to the base 80 and a pair of upwardly extending contact legs 88 having inwardly bent closely spaced planar contact sections 89 that resiliently deflect outwardly upon mating with the associated host neutral blade in assembly. Ribs 83 maintain the position of the terminal in the pocket.

The ground lead contact assembly 48 includes the ground post 55 riveted to the base 90 of a ground terminal 92. Referring to FIG. 4, the base 90 is carried on a lower mounting pad 49 and the terminal 92 registers with the pocket 68 therefor in the housing and the ground hole 66 in the housing 22. The ground post 55 registers with and extends through the hole in the base of the cover assembly 24. The ground terminal 92 includes a pair of upwardly extending contact legs 98 having inwardly bent spaced contact sections 99 that resiliently deflect outwardly upon mating with the associated host ground post in assembly. Ribs 100 at the ends of the pocket maintain the axial position of the terminals.

The cover plate 24 is assembled by aligning the contact assemblies with the respective pocket and inserting the shoulder into the counterbore of the cavity 34. Thereafter, the fasteners 26 are inserted into the respective holes in the cover plate 24 and the shanks thereof tapped into the inserts 71.

The thus assembled adapter 10 may be conveniently carried on board the transport and if a suitable electrical service is not available inserted into an available receptacle and the transport plug connected. The compact high strength envelope and in-line isolated axial connections provide a safe and reliable interface resistant to environmental conditions and normal physical encounters. Fully satisfactory performance has been achieved in an adapter having about a 2¼ inch diameter and about a 2 inch length.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention.

The disclosures and description herein are intended to be illustrative and are not in any sense limiting of the invention, which is defined solely in accordance with the following claim.

What is claimed:

1. An in-line AC adapter for interfacing between an electrical receptacle having a three socket array characterized by laterally spaced slots and an orthogonal grounding slot and an electrical plug having a four blade array a first pair of laterally spaced blades and a second pair of orthogonally spaced blades, said adapter comprising: a housing member having a peripheral wall and a base wall forming a frontally opening cavity; wall means in said cavity providing first and second pairs of frontally opening pockets including slots in said base wall registering with said four blade array; a cover member overlying said cavity and engaging said peripheral wall of said housing member, said cover member having slots registering with said three socket array; a first terminal assembly including a first base portion carried on said cover member at a first mounting position, said first terminal assembly including first and second terminal means carried in said first pair of opposed pockets for electrical engagement by blades of said first array; a blade connecting member including said first base portion electrically connecting said first and second terminal means; a first blade member electrically connected with said first connecting member extending through one of said slots in said cover member for reception in a slot of said receptacle array; a second terminal assembly including a second base portion carried on said cover member at a second mounting position, said second terminal assembly including third terminal means carried in one pocket of said second pair, a third terminal assembly including a third base carried on said cover member at a third mounting location, said third terminal assembly including fourth terminal means carried in the other socket of said second pair, said third terminal assembly having a third blade member extending thought the remaining slot in said cover member for reception in the remaining slot of said receptacle array, whereby said wall means laterally isolate said terminal means for a first level of electrical separation; and fastener means for connecting said housing member to said cover member.

2. The in-line AC adapter as recited in claim 1 wherein said first terminal assembly forms a hot current path, said second terminal assembly forms a neutral current path and said third terminal assembly forms a ground path.

3. The in-line AC adapter as recited in claim 2 wherein stop means in said pockets limit longitudinal movement of said terminal means.

4. The in-line AC adapter as recited in claim 2 wherein said mounting positions are at differing heights on said cover member to vertically isolate said terminals for a second level or electrical separation.

5. The in-line AC adapter as recited in claim 4 wherein said first blade member is integral with said first connector member.

6. The in-line AC adapter as recited in claim as recited in claim 5 wherein said second blade member is integral with said second base.

7. The in-line AC adapter as recited in claim 1 wherein said side wall of said housing includes raised transverse sections for facilitating installation and removal of the adapter.

8. The in-line AC adapter as recited in claim 7 wherein said side wall of said housing member includes cylindrical sectors peripherally spaced by planar areas having said transverse sections.

9. In a recreation facility having a 30 ampere electrical three slot receptacle with a NEMA TT-30R configuration including a hot contact, a neutral contact and a ground contact, and a transport vehicle having a four blade plug with a NEMS-TT-50P configuration including a pair of hot blades, a neutral blade and a ground blade, an adapter for electrically connecting the plug with the receptacle comprising: a thermoplastic housing having a base wall and a side wall; first wall means in said housing forming four transversely spaced and forwardly opening pockets terminating at said base wall with a first set of four slots registering with the configuration of the plug; double legged contact terminals means disposed in said pockets for registering with and electrically connecting in assembly with the blades of the plug, said terminal means being transversely electrically isolated by said first walls means; connector means extending transversely above said wall means for electrically interconnecting terminals means registering with the pair of hot blades of said plug; a cover connected to said housing having a second set of three slots registering with the configuration of the receptacle; a first blade member attached to said connector means and extending through a slot in said second set for registering with and electrically connecting in assembly with the hot contact of said receptacle; a second blade member extending through a slot in said second set and attached to the terminal means registering with a neutral contact of said receptacle; and a third blade member extending through a slot in said second set and attached to the terminal means registering with a ground contact of said receptacle, and second wall means on said cover carrying said connector means and electrically isolating said second blade member and said third blade member therefrom.

* * * * *